US006024241A

United States Patent [19]

Keillor

[11] Patent Number: 6,024,241

[45] Date of Patent: Feb. 15, 2000

[54] BOX DIVIDER

[76] Inventor: Ronald J. Keillor, 811 Highland Ave., Frankfort, Mich. 49635

[21] Appl. No.: 09/058,643

[22] Filed: Apr. 10, 1998

[51] Int. Cl.[7] ..... B65D 1/22; B65D 25/06

[52] U.S. Cl. ..... 220/529; 220/534; 220/540; 229/120.07; 229/120.34

[58] Field of Search ..... 206/561; 312/193, 312/348.3, 351; 229/120.33, 120.34, 120.07; 220/528, 529, 534, 541, 542, 559, 535, 540, 553

[56] References Cited

U.S. PATENT DOCUMENTS

| | | | |
|---|---|---|---|
| 436,626 | 9/1890 | Dixon | 206/561 |
| 560,893 | 5/1896 | Conant . | |
| 990,319 | 4/1911 | Walton | 220/541 |
| 1,017,812 | 2/1912 | Schmelzer | 220/561 X |
| 1,713,328 | 5/1929 | Brenner . | |
| 1,849,024 | 3/1932 | McKee . | |
| 1,906,191 | 4/1933 | Thomas et al. . | |
| 2,101,378 | 12/1937 | Wiskoff . | |
| 2,148,681 | 2/1939 | Cameron . | |
| 2,214,042 | 9/1940 | Burdick | 312/348.3 X |
| 2,218,300 | 10/1940 | Schuster . | |
| 2,246,967 | 6/1941 | Zalkind . | |
| 2,299,134 | 10/1942 | Eppes . | |
| 2,824,349 | 2/1958 | Baldacci . | |
| 3,002,632 | 10/1961 | George . | |
| 3,063,717 | 11/1962 | Hare | 312/351 X |
| 3,220,789 | 11/1965 | Kronenberger | 312/351 X |
| 3,250,421 | 5/1966 | Braun | 312/351 X |
| 3,391,816 | 7/1968 | Swett . | |
| 3,501,020 | 3/1970 | Krikorian . | |
| 3,613,178 | 10/1971 | Fisher | 220/529 |
| 3,692,191 | 9/1972 | Moore . | |
| 4,081,100 | 3/1978 | Presby . | |
| 4,102,470 | 7/1978 | Timmons . | |
| 4,164,312 | 8/1979 | Harned . | |
| 4,389,133 | 6/1983 | Oberst . | |
| 4,726,635 | 2/1988 | Rariden et al. . | |
| 4,770,314 | 9/1988 | Giesler . | |
| 4,889,253 | 12/1989 | Schmulian et al. . | |
| 4,964,528 | 10/1990 | Wagoner . | |
| 5,082,139 | 1/1992 | Quam . | |
| 5,111,959 | 5/1992 | Glickman . | |
| 5,199,568 | 4/1993 | Streit et al. . | |
| 5,207,347 | 5/1993 | Wilkey . | |
| 5,312,180 | 5/1994 | Tieder et al. . | |

FOREIGN PATENT DOCUMENTS

| | | | |
|---|---|---|---|
| 527986 | 1/1957 | Belgium . | |
| 429015A | 5/1991 | European Pat. Off. . | |
| 1033688 | 3/1956 | Germany | 312/351 |

*Primary Examiner*—Allan N. Shoap
*Assistant Examiner*—Joe Merek
*Attorney, Agent, or Firm*—Van Dyke, Gardner, Linn & Burkhart, LLP

[57] ABSTRACT

A box divider used in conjunction with boxes having differing side wall thicknesses includes a vertical partition which carries locking assemblies on its opposing sides. The locking assemblies operationally engage a pair of mounting pins horizontally extending within the interior of the box. The locking assemblies are vertically adjustable and abuttingly contact ribs formed along the body of the mounting pins. The bottom of the partition includes a base having a series of spikes depending therefrom which penetrate the bottom surface of the box to thereby hold the same securely in place. The back surfaces of the locking assemblies are formed having a high coefficient of friction, to thereby frictionally engaging the interior surface of the box. The locking assemblies each preferably include a guide having a vertical channel onto which is slidably mounted a wedge having a channel in registration with the channel formed in the guide. The wedge is slid in a downward direction to abuttingly contact a rib formed in the mounting pin.

22 Claims, 6 Drawing Sheets

40
150
34
20
58
45
50
56
63
53
65
62
164
70
165
64
68
82
78
82
52
48
49
50
56
47
53
51
45
46
49
47
51
49
47
45
56
46
54
58
46
49
50
47
56
58
45
54
48
57
49

BOX DIVIDER

BACKGROUND OF THE INVENTION

This invention relates generally to box and container assemblies. In particular, the present invention pertains to a divider used to segregate a box or container into discrete compartments.

It is well known in the art to employ dividers vertically positioned within the interior of a box or container. These dividers serve to segregate the interior into two or more compartments, and are beneficial for several reasons. First, if the box in which the divider is used is employed to store documents, a divider enables storage of a variety of documents segregated in accordance with a preselected identification system, such as by category or type of document. Also with respect to boxes that carry documents, use of a divider maintains their vertical position within the interior when the box is not full.

Box dividers also find application in storing and transporting items other than documents, especially fragile items. These dividers may be positioned within the interior in proximity to the item, thereby holding the same within a particular region of the box. Thus during transportation, the item or items are less likely to move about the interior of the box. This in turn protects such items from damage caused by contact with other items in the box and by the jarring motion typically encountered during transportation.

Normally, such dividers are used in conjunction with a conventional container in the form of either a carton or a box made of a corrugated material such as cardboard. The box includes a pair of opposing side walls joined by end walls and a bottom, defining an interior. Optionally, these boxes contain a cover placed over the top to thereby enclose the interior. Also, to aid in transportation, the ends walls may be fitted with apertures dimensioned to allow the user to grasp the box and lift the same. These boxes are sold by a variety of different manufacturers, and depending on the materials used and the rigidity desired, the thickness of the box walls often varies.

While the varying thickness of the end walls does not present a problem for current dividers, varying thicknesses between the side walls has presented a problem for prior art dividers which has heretofore been unaddressed. This problem stems from the fact that the width of the box, as measured by the distance between the exterior surfaces of the side walls, is altered by either increasing or decreasing the thickness of the material used to construct the side walls. Since these boxes vary in side wall thickness, dividers constructed to fit one size box cannot be adjusted or modified to fit another box having a different side wall thickness. This inability to provide an adjustable divider increases costs to the manufacturers by having to create entirely separate dividers sized to fit boxes of varying dimension. Furthermore, this lack of adjustability greatly increases the inconvenience to the consumer, since a divider dedicated to a box having a certain side wall thickness cannot be altered or adjusted to fit a different size box.

Beyond their lack of adjustability prior art dividers, due to their particular construction, often fail to stay in place. This is so because many such dividers contain flanges or winged members that engage the top edges of the side walls. During transportation, when the boxes are filled with documents, these dividers have a tendency to slide along the top edge of the side walls, thereby defeating the purpose of a stable rigid partition.

Thus, there exists a need for a box divider which can be adjusted to fit boxes with differing side wall thicknesses, and maintains its rigid position within the interior of the box during transportation.

SUMMARY OF THE INVENTION

The present invention overcomes the difficulties of the prior art by providing a box divider having a vertical partition positioned within the box and carrying a pair of locking members which engage respective mounting members projecting from the side walls of the box. Depending upon the side wall thickness, the locking members will abuttingly contact a different position along mounting members to thereby hold the partition securely in place. Preferably, the locking members are slidably adjustable and are most preferably vertically adjustable.

According to another aspect of the invention, the partition carries a pair of locking assemblies supported on opposite sides of the partition. These locking assemblies include a guide member which slidingly receives a wedge formed with a vertical channel. To secure the divider within the box, the wedges are moved in a downward direction whereby the mounting members are received by the channels and are placed in abutting relation with the front surface of the wedges. This abutting contact between the wedges and the mounting members serve to hold the partition in a stable vertical position.

According to another aspect of the invention, the mounting members are comprised of a pair of pins, each of which is placed on opposing side walls of the box. Each pin includes a flat head, placed flush against the exterior surface of the side wall, and a body member having a series of ribs thereon. Also, the end of the body is tapered to a point thereby facilitating penetration of the pin through the side wall. The presence of these ribs in combination with the sliding wedge permits the wedges to be removably placed in contact with a particular rib formed along the body of the pin. This feature allows the box divider of the present invention to be used in conjunction with a variety of boxes having side walls of varying thickness.

According to another aspect of the invention, the guide members extend in a orthogonal direction from the surface of the partition with the back surface of the guide members positioned flush against the interior surface of the side walls. Preferably, each back surface is formed to have a high coefficient of friction, thereby preventing the partition from moving or slipping within the interior of the box.

According to yet another aspect of the invention, the bottom of the partition is formed with a base having a bottom surface. This bottom surface has depending therefrom one or more spikes which penetrate the bottom surface of the box and thereby serve to hold the partition securely within the interior of the box.

The present invention is especially useful with boxes which are sold in a folded state and constructed by the user. Such boxes come in a variety of configurations having one, two and sometimes three wall thicknesses. The box divider of the present invention can be used with boxes having a variety of wall thicknesses and lock rigidly in place.

These and other objects, advantages and features of this invention will become apparent upon review of the following specification in conjunction with the drawings.

DETAILED DESCRIPTION OF THE PREFERRED EMBODIMENTS

Figure 1:
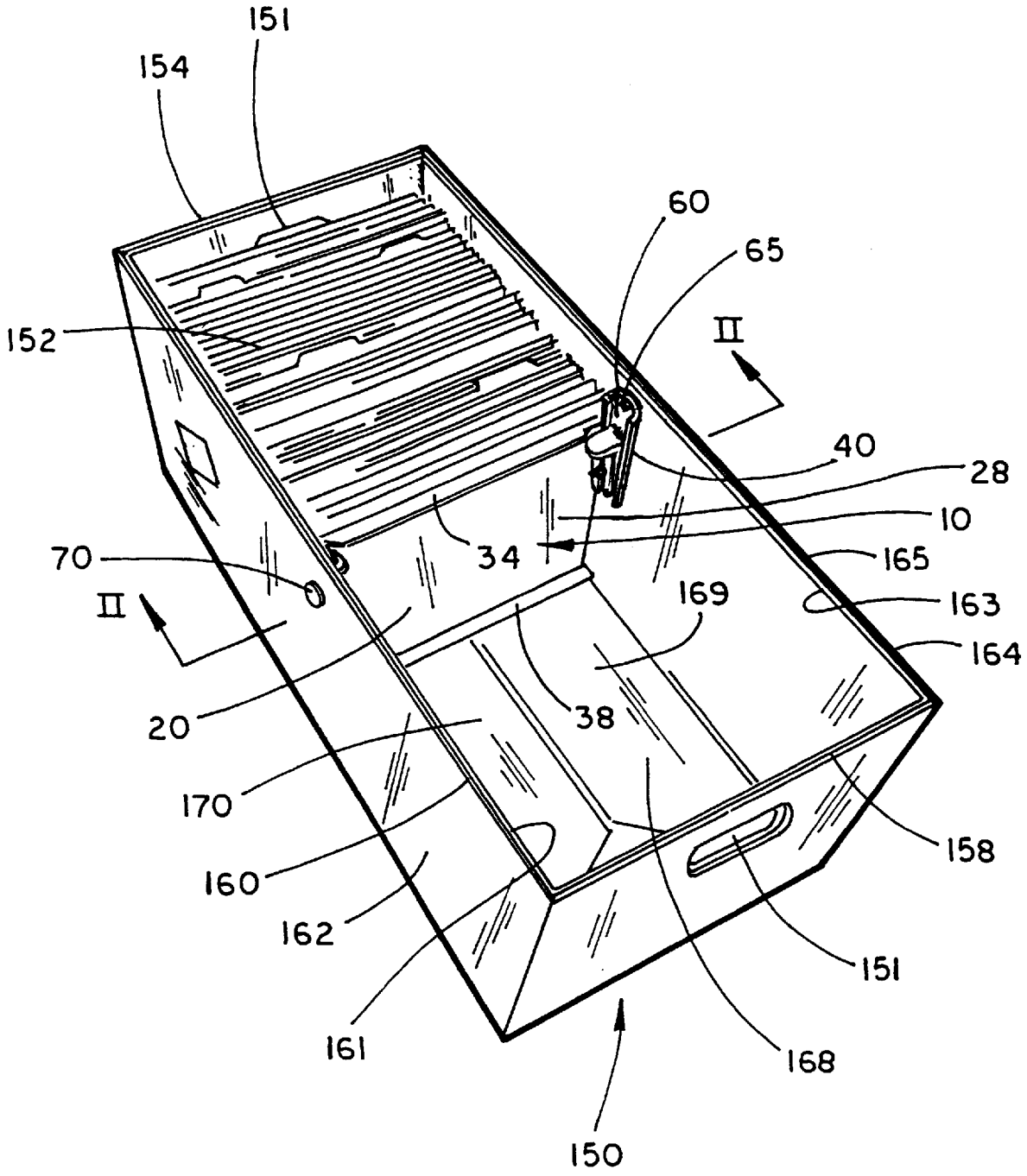
FIG. 1 is a perspective view of a box divider according to the invention, illustrated positioned within a box.
Figure 3:
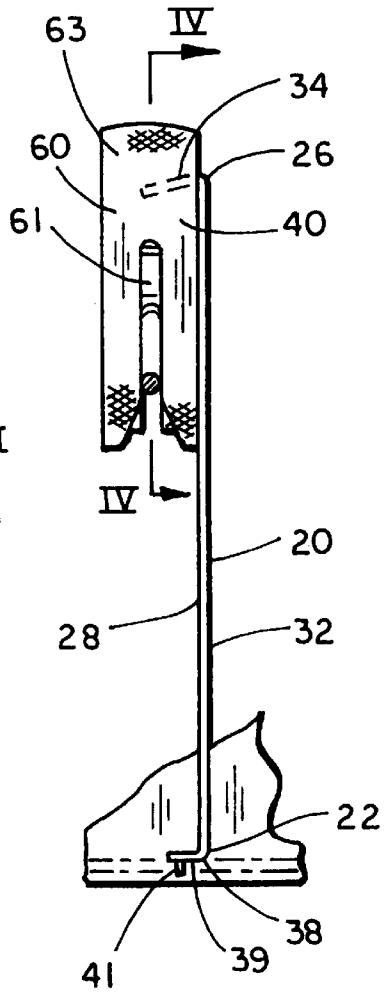
FIG. 3 is a sectional view of the box divider of FIGS. 1 and 2 taken along line III—III of FIG. 2.
Figure 2:
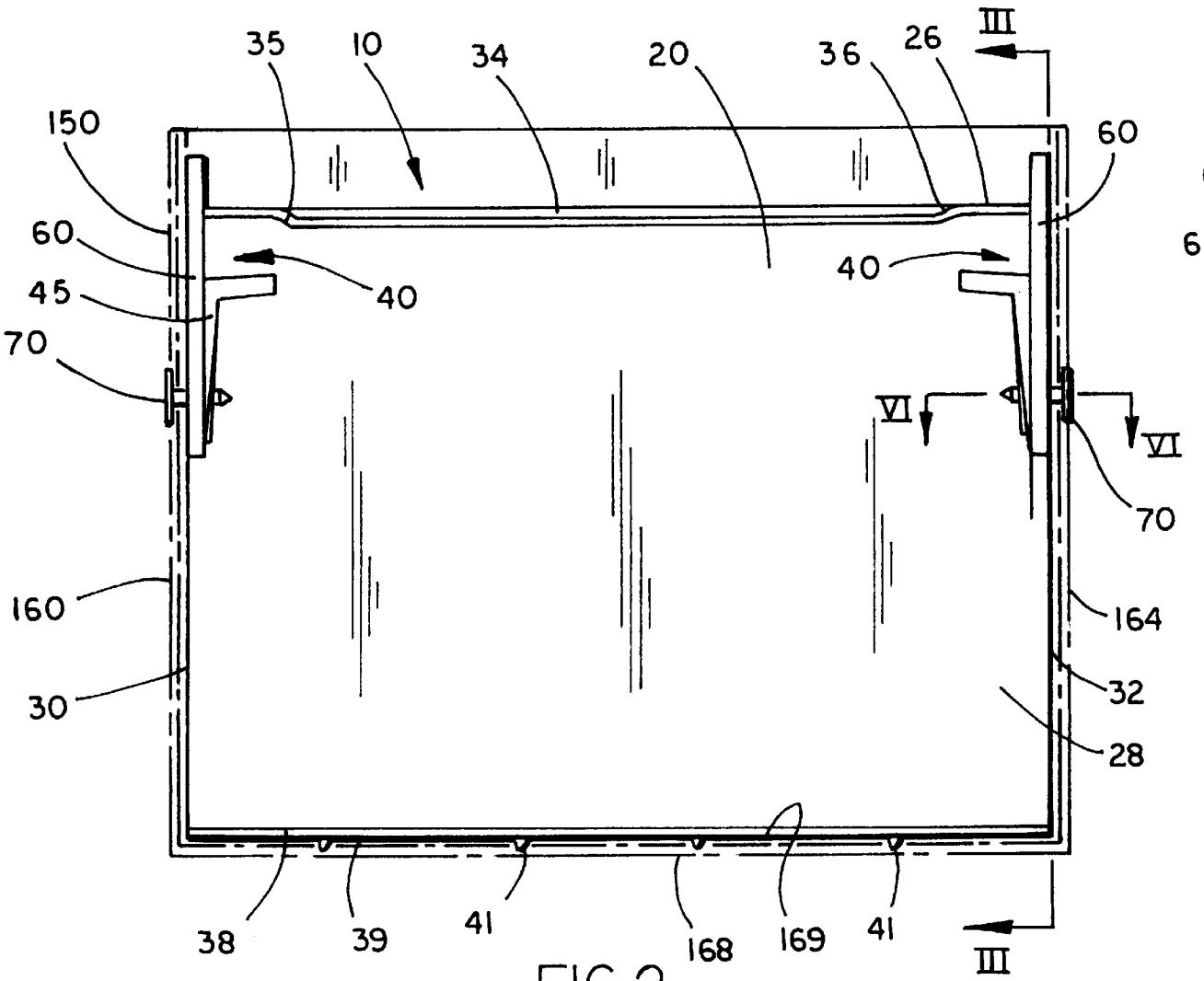
FIG. 2 is a sectional view of the box divider in FIG. 1 taken along line II—II of FIG. 1.
Figure 6:
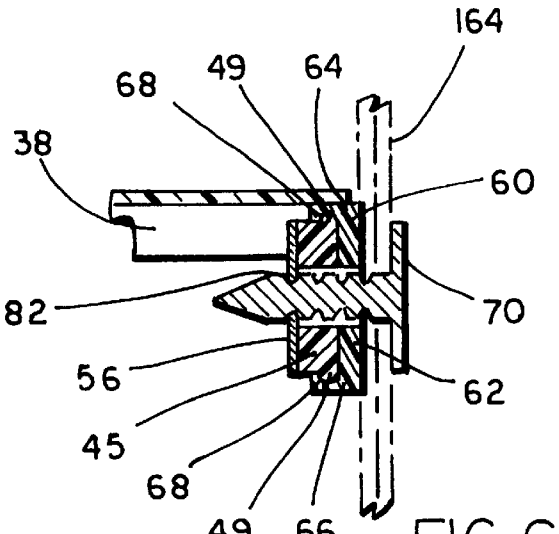
FIG. 6 is a sectional view of the mounting pin and locking assembly of FIGS. 1–5 taken along line VI—VI of FIG. 2.

Referring now specifically to the drawings, and the illustrative embodiments depicted therein, there is shown a box divider according to a preferred embodiment of the present invention and generally designated by reference numeral 10, illustrated secured within a box 150. Box 150 is well known in the industry and is frequently used to store and transport a variety of goods. As illustrated in FIG. 1, box 150 is configured to contain a series of paper documents 152. However, it is to be recognized that box 150 is also utilized in the storage and transportation of a variety of other items. Box 150 generally comprises a pair of opposing end walls 154 and 158, a pair of opposing side walls 160 and 164, and a bottom 168 defining an interior 170. To facilitate transportation, end walls 154 and 158 of box 150 may be equipped with cut out portions 151 enabling a user to grasp box 150. Box 150 is typically formed of a corrugated material such as cardboard. Box 150 may further include a top (not shown) which encloses interior 170 and protects the items stored therein. Since box 150 is most often employed to store and transport documents, the width of interior 170 is normally approximately 12 inches. However, depending upon the material used, and the strength desired, the thickness of end walls 154 and 156, bottom 168 and especially side walls 160 and 164 often vary.

Divider 10 includes a partition 20 having a bottom 22, a top 26 and opposing sides 30 and 32. A pair of locking assemblies 40 extend approximately orthogonally from front surface 28 of partition 20 from opposing sides 30 and 32. Preferably, locking assemblies 40 extend above the plane defined by top 26 of partition 20. Each locking assembly 40 removably engages a mounting member or pin 70 projecting within interior 170 of box 150 to thereby secure partition 20 in a rigid, vertical position.

Figure 4:
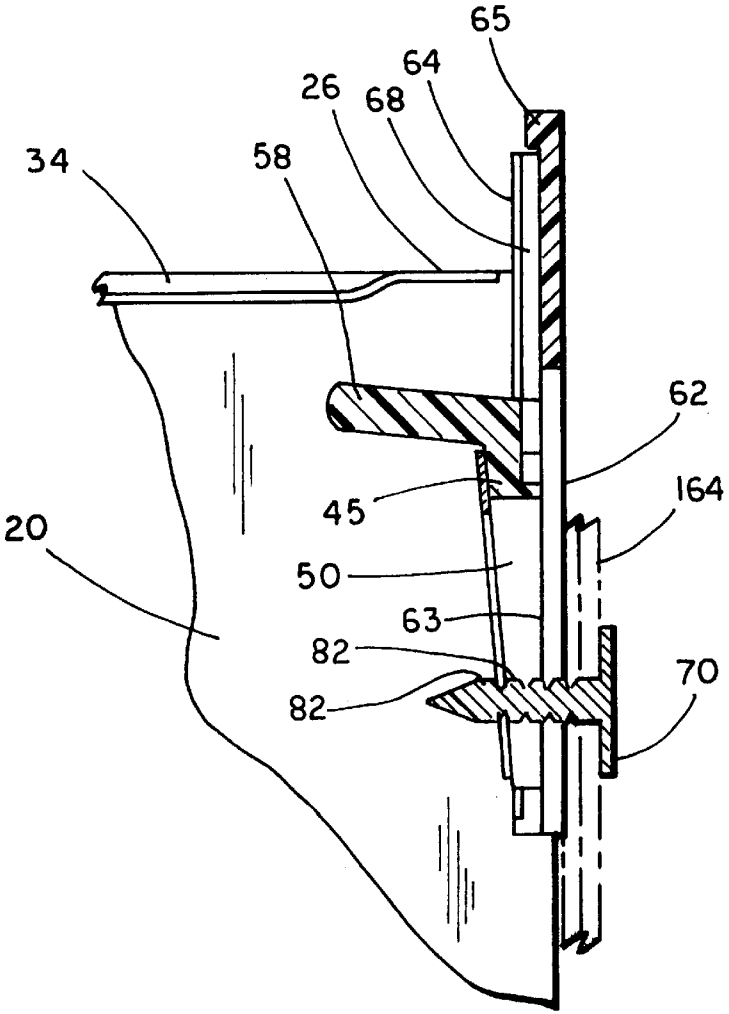
FIG. 4 is a sectional view of a mounting pin and locking assembly of FIGS. 1–3 taken along line IV—IV of FIG. 3.
Figures 5, 7, 8, 9:
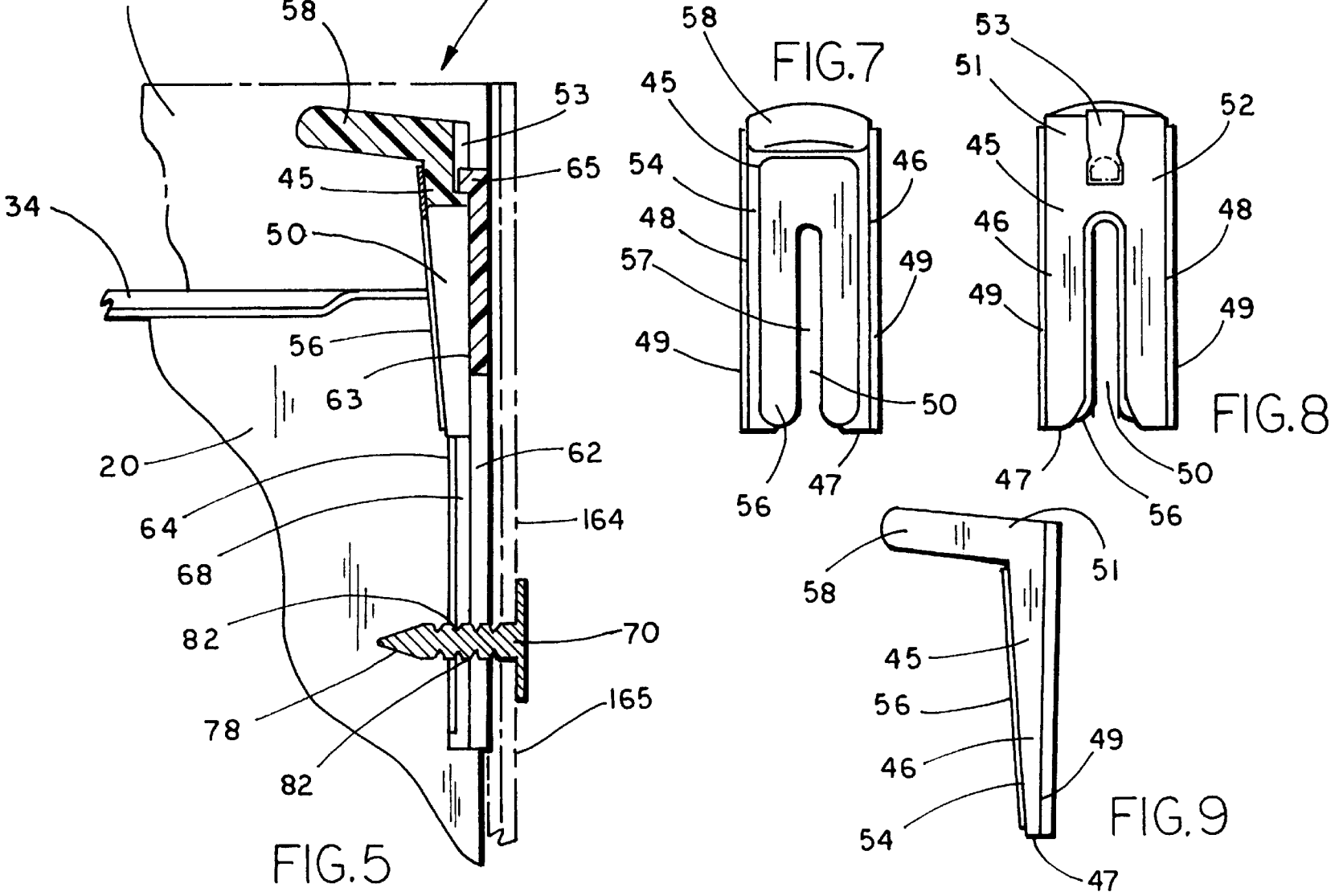
FIG. 5 is a sectional view of a mounting pin and locking assembly of FIGS. 1–4 illustrated in the unsecured position.
FIG. 7 is an elevational view of the wedge of the locking assembly shown in FIGS. 1–6.
FIG. 8 is an elevational view of the wedge of the locking assembly shown in FIGS. 1–7.
FIG. 9 is an elevational view of the wedge of the locking assembly shown in FIGS. 1–8.

In a preferred embodiment, and as illustrated in FIGS. 1 through 6 locking assemblies 40 each include a wedge 45 slidably positioned within a guide 60. Guide 60 contains a body 62 attached to opposing sides 64 and 66. Opposing sides 64 and 66 are each formed with a groove 68. As shown most clearly in FIG. 3, body 62 of guide 60 has a vertical channel 61 formed therethrough. Preferably, partition 20 and guide 60 of locking assemblies 40 are integrally formed of a material having requisite strength and rigidity. Such materials include, but are not limited to polymers, metals, metal alloys and composites. As shown in FIGS. 1, 4 and 5, front surface 63 of body 62 has extending therefrom a protuberance 65 positioned above vertical channel 61.

Wedge 45 has a pair of opposing sides 46 and 48, with each side 46 and 48 having a flange 49 extending therefrom. Flange 49 of sides 46 and 48 of wedge 45 are received by grooves 68 of guide 60, thereby enabling the vertical adjustment of wedge 45 within guide 60. A vertical channel 50 is formed in wedge 45 and extends from bottom 47 and terminates a preselected distance from top 51. When positioned in guide 60, vertical channel 50 of wedge 45 is in registration with vertical channel 61 of guide 60. A cut out 53 is formed in back 52 of wedge 45 and receives protuberance 65 of guide 60 and hence prevents wedge 45 from being removed from the top of guide 60. Front surface 54 of wedge 45 has attached thereto a plate 56 also formed with a vertical channel 57. Plate 56 is preferably formed of a metal, metal alloy or polymer having a low coefficient of friction and low malleability. A tab or handle 58 extends from top 51 of wedge 45, enabling a user to slide wedge 45 along guide 60. Handle 58 extends from wedge 45 at an angle, however, it is to be recognized by those with ordinary skill in the art that handle 58 may extend perpendicularly from top 51 of wedge 45 without departing from the spirit and scope of the present invention.

Figure 10:
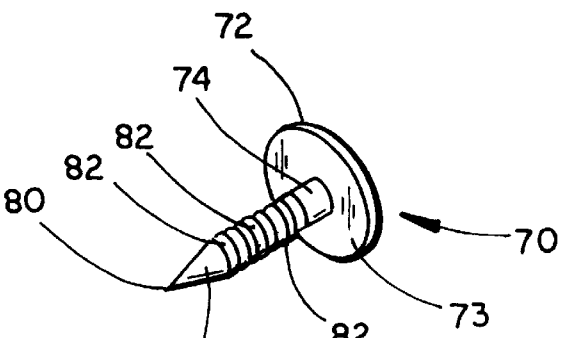
FIG. 10 is a perspective view of a mounting pin.

Mounting pin 70, shown most clearly in FIG. 10 contain a flat head 72 from which a body 74 extends. Body 74 has an end 78, which is preferably tapered to a sharp point 80. A plurality of ribs 82 are formed along the length of body 74 of mounting pin 70. In a preferred embodiment, body 74 contains four ribs 82. Mounting pin 70 may be made of any material commonly employed in the art having sufficient strength and rigidity.

Figure 14:
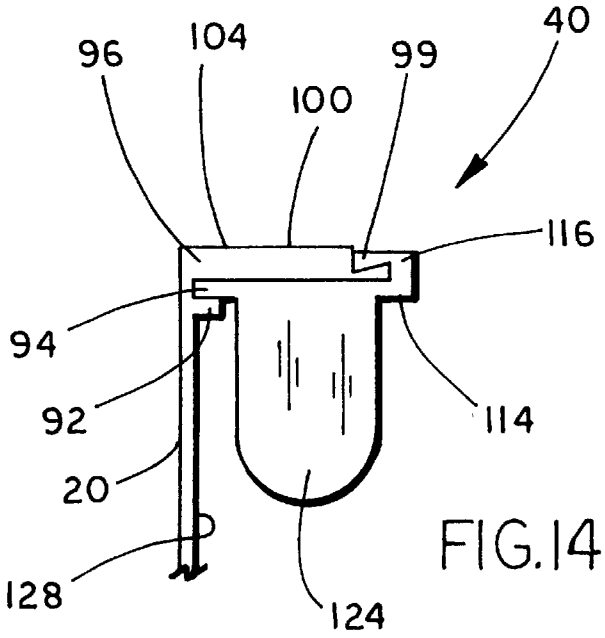
FIG. 14 is a top view of the locking assembly illustrated in FIG. 13.
Figure 13:
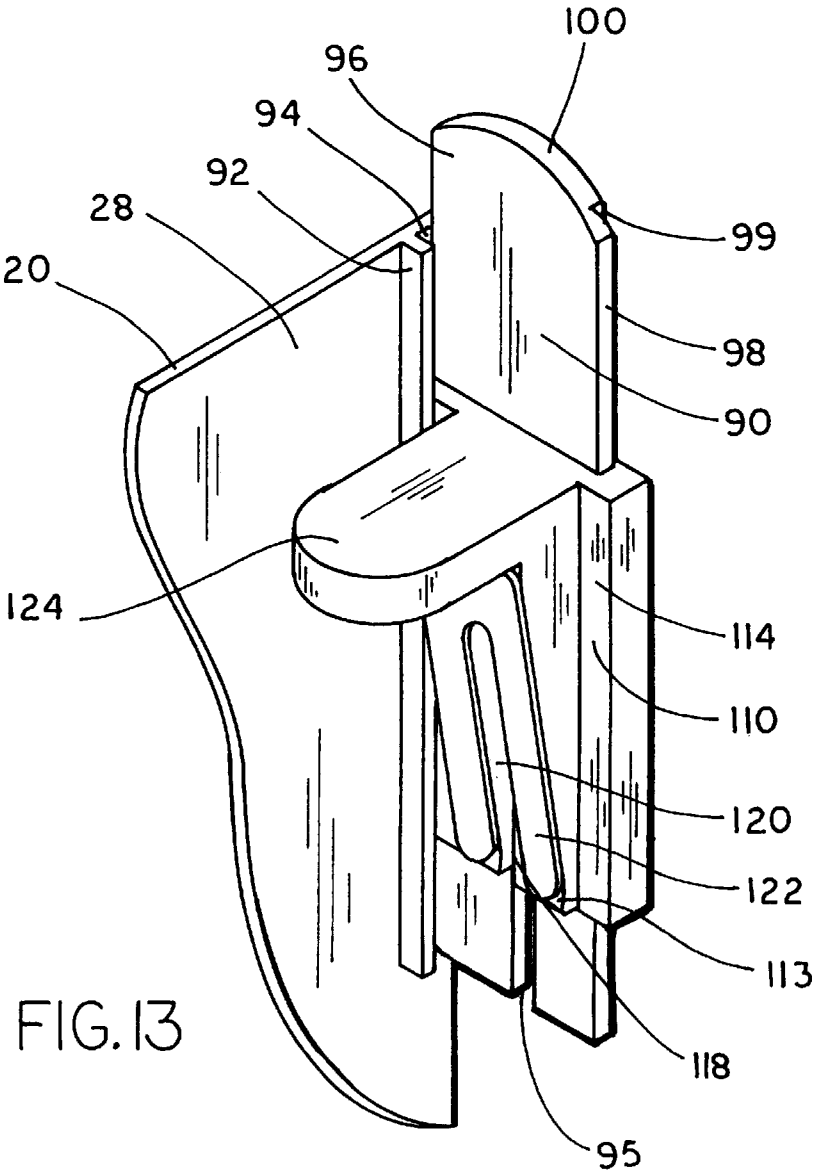
FIG. 13 is a perspective view of a locking assembly according to an alternative preferred embodiment.

Turning now to FIGS. 13 and 14, there is illustrated an alternative preferred embodiment for locking assemblies 40. In this embodiment, a guide 90 is comprised of a first member 92 extending from front surface 28 of partition 20 and a second member 96, also extending from front surface 28 of partition 20 and placed in space relation with first member 92. Second end 98 of second member 96 is formed with a vertical groove 99 along back surface 100. Groove 99 is preferably cut at on oblique angle. Wedge 110 has a first side 112 which is received in space 94 defined between first member 92 and second member 94. Second side 114 of wedge 110 is formed with a lip 116. Thus, vertical movement of wedge 110 within guide 90 is achieved by inserting first side 112 of wedge 110 into space 94 and positioning lip 116 within groove 99 of second member 96.

In this embodiment, second member 96 of guide 90 contains a vertical channel 95 extending from bottom 97 and terminating a predetermined distance from top 93. Vertical channel 95 is in registration with a vertical channel 118 formed in wedge 110 and channel 120 formed in front plate 122 positioned over front surface 113 of wedge 110. A handle 124 extends from top 111 of wedge 110.

A top member 34 extends from top 26 of partition 20. Top member 34 contains tapered ends 35 and 36. Tapered ends 35 and 36 permit wedge 45 or 110 to be moved above the plane defined by top 26 of partition 20 during insertion and removal of divider 10 from box 150. A base 38 extends substantially orthogonally from bottom 22 of partition 20. Base 38 has a bottom surface 39, having a plurality of spikes 41 depending therefrom. When divider 10 is positioned within interior 170 of box 150, spikes 41 penetrate surface 169 of bottom 168 of box 150 to thereby hold partition 20 securely in place.

Rear surfaces 63 of guides 60 of locking assemblies 40 are formed of a material having a high coefficient of friction. Alternatively, rear surfaces 63 may be formed to have a grid or nub pattern thereon which provides the requisite friction. Similarly, rear surfaces 104 of second members 96 of guide 90 are formed to have a surface exhibiting a high coefficient of friction. When positioned in box 150 rear surfaces 63 of guide members 60, or rear surfaces 104 of second members 96 are positioned flush against interior surfaces 161 and 163 of side walls 160, 164, respectively and thereby serve to hold partition 20 securely in place within interior 170 of box 150.

In operation, mounting pins 70 are pushed through side walls 160 and 164 until interior surface 73 of head 72 is flush against exterior surfaces 162 and 165 of side walls 160 and 164. Mounting pins 70 should be positioned straight across from one another in side walls 160 and 164, at a preselected distance above bottom 168 of box 150. Thereafter, wedges 45 or 110 are moved vertically upward to the top of guide 60 or 90. Partition 20 is then placed within interior 170 of box 150 such that mounting pins 70 are positioned within channels 61 or 95 of the respective guides 60 or 90. A slight force is applied to the top of top member 34 in a downward direction to thereby urge spikes 41, located on bottom surface 37 of base 38, to penetrate the interior surface 119 of bottom 168 of box 150. Thereafter, using handle 58 or 124, wedges 45 or 110 are pushed in a downward direction until abutting contact is achieved between a particular rib 82 of mounting pin 70 and front surface 54, or 113 of wedge 45 or 110.

Figure 12:
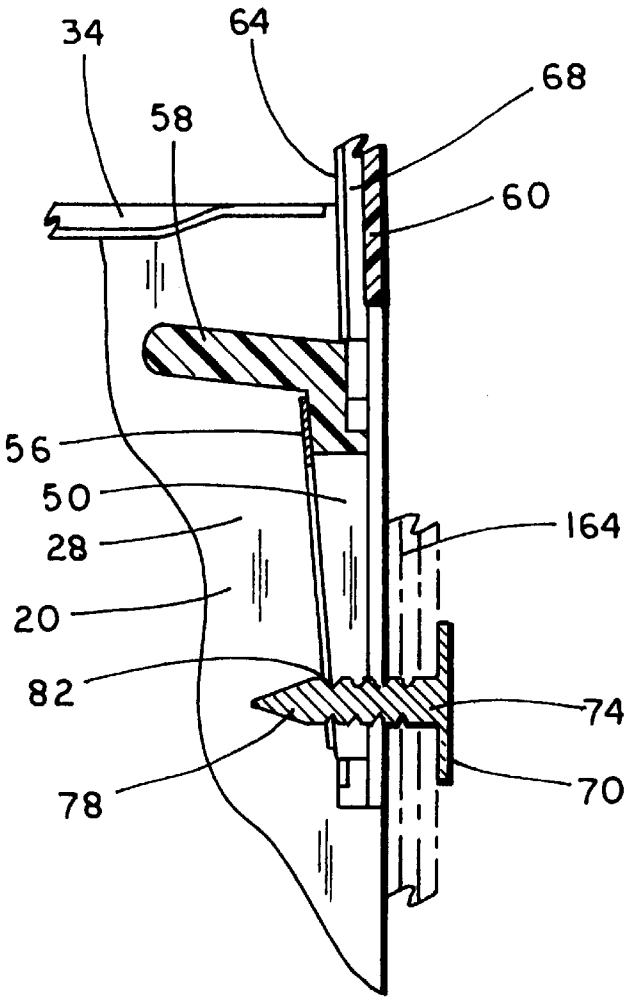
FIG. 12 is a sectional view of a mounting pin and locking assembly attached to a box having a side wall thickness different from that illustrated in FIG. 11.
Figure 11:
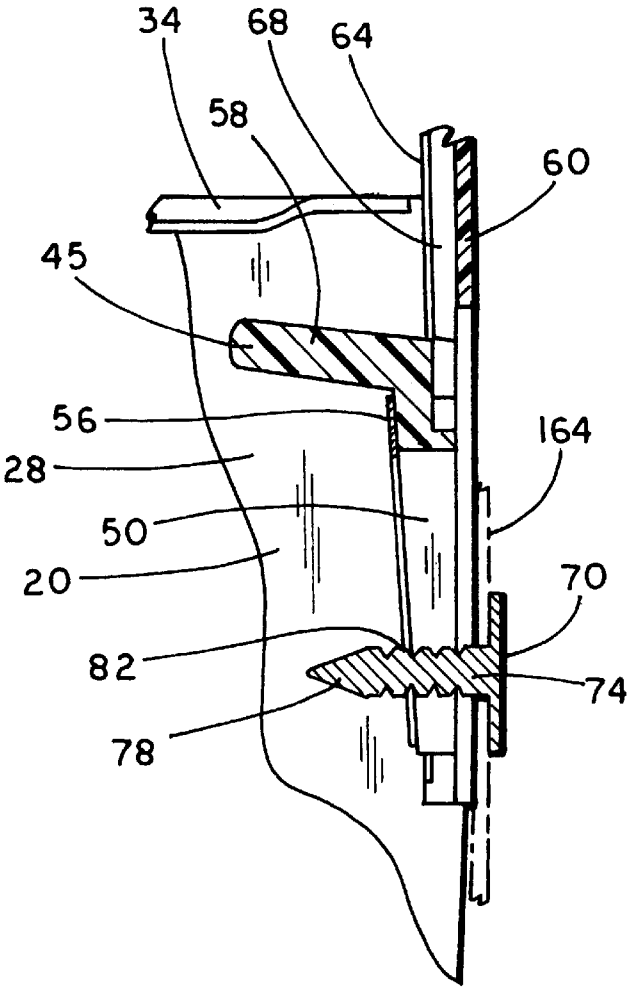
FIG. 11 is a sectional view of a mounting pin and locking assembly attached to a box having a certain side wall thickness.

As most clearly depicted in FIGS. 11 and 12, the combination of locking assemblies 40 in conjunction with mounting pins 70 enable divider 10 to be used in conjunction with a variety of boxes having different side wall thicknesses. As shown in FIG. 11, mounting pin 70 is shown extending through a side wall 160 having a certain thickness. Given the thickness of side wall 160, wedge 45 or 110 will abuttingly engage an intermediate rib 82 positioned along the body 74 of mounting pin 70. A shown in FIG. 12, mounting pin 70 is positioned through a side wall 160 having a thickness greater than that depicted in FIG. 11. Thus, wedge 45 or 110 engages a rib 82 positioned closer to end 78 of mounting pin 70. Hence, the adjustability of divider 10 permits a user to use the above described invention in conjunction with a variety of boxes having different side wall thicknesses.

Changes and modifications in the specifically described embodiments can be carried out without departing from the principles of the invention, which is intended to be limited only by the scope of the appended claims, as interpreted according to the principles of patent law including the doctrine of equivalents.

The embodiments of the invention in which an exclusive property or privilege is claimed are defined as follows:

1. A box having a box divider comprising:

the box having a pair of ends, a bottom, and a pair of opposing side walls defining an interior;

a partition received by the interior of said box, said partition having opposing sides, a top, a bottom and a front surface;

a pair of locking members carried by said opposing sides of said partition, wherein each locking member of said pair of locking members comprises a wedge having a channel formed therein; and a pair of mounting members projecting from said opposing side walls into the interior of said box, said pair of locking members engaging said pair of mounting members to removably secure said partition within said interior of said box, said channel receiving a mounting member of said pair of mounting members.

2. A box having a box divider comprising:

the box having a pair of ends, a bottom, and a pair of opposing side walls defining an interior;

a partition received by said interior of said box, said partition having opposing sides, a top, a bottom and a front surface;

a pair of locking members carried by said opposing sides of said partition, wherein said pair of locking members are slidingly adjustable; and a pair of mounting members projecting from said opposing side walls into said interior of said box, said pair of locking members engaging said pair of mounting members to removably secure said partition within said interior of said box, wherein each mounting member of said pair of mounting members comprises a pin extending through a side wall of said pair of opposing side walls, said pin having at least one rib formed therealong, each locking member of said pair of locking members engaging said at least one rib.

3. The box divider as recited in claim 1, further comprising a base extending substantially orthogonally from said bottom of said partition, said base having a bottom surface and at least one spike depending from said bottom surface.

4. The box divider as recited in claim 1, further comprising a top member extending from said top of said partition.

5. A box having a box divider comprising:

the box having a pair of ends, a bottom and a pair of opposing side walls defining an interior;

a partition received by said interior of said box, said partition having opposing sides a top, a bottom and a front surface;

a pair of locking members carried by said opposing sides of said partition, wherein each locking member of said pair of locking members comprises:

a guide member extending from a side of said opposing sides of said partition, said guide member having a vertical channel formed therein, and a wedge slidably mounted on said guide member, said wedge having a top and a front surface, said wedge formed with a vertical channel in relation with said vertical channel formed in said guide member, said vertical channel formed in said wedge dimensioned to receive a mounting member of said pair of mounting members; and a pair of mounting members projecting from said opposing side walls into said interior of said box, said pair of locking members engaging said pair of mounting members to removably secure said partition within said interior of said box.

6. The box divider as recited in claim 5, wherein said guide member extends beyond said top of said partition.

7. The box divider as recited in claim 5, wherein said guide member further comprises:

a first vertical member attached to said partition, a second vertical member positioned in spaced relation to said first vertical member, said second vertical member having a vertical channel formed therethrough, a first side attached to said partition and a second side formed with a groove, and wherein said wedge has a vertical channel formed therethrough in registration with said channel formed in said second vertical member, said wedge having a first side and a second side, said first side positioned between said first vertical member and said second vertical member, said second side having a lip formed therein, said lip received by said groove formed in said second side of said second vertical member.

8. The box divider as recited in claim 5, wherein said wedge further comprises a handle extending from said top.

9. The box divider as recited in claim 5, wherein said pin further comprises a substantially flat head positioned flush with the exterior surface of a side wall of the pair of side walls, and wherein said at least one rib is at least three ribs.

10. The box divider as recited in claim 9, further comprising a base extending substantially orthogonally from said bottom of said partition, said base having a bottom surface, said bottom surface having at least one spike depending therefrom.

11. The box divider as recited in claim 9, further comprising a top member extending from said top of said partition, said top member having tapered ends.

12. A box having a box divider comprising:

the box having a pair of ends, a bottom, and a pair of opposing side walls defining an interior;

a partition received by the interior of the box, said partition having opposing sides, a top, a bottom and a front surface;

a pair of locking members carried by said opposing sides of said partition, wherein said pair of locking members are slidingly adjustable, wherein each locking member of said pair of locking members is formed with a back surface having a high coefficient of friction, said back surface of said each locking member contacting a side wall of said pair of opposing side walls when said partition is positioned in said interior of said box; and a pair of mounting members projecting from said opposing side walls into said interior of said box, said pair of locking members engaging said pair of mounting members to removably secure said partition within said interior of said box.

13. A box having a box divider comprising:

the box having a pair of ends, a bottom and a pair of opposing side walls defining an interior, a partition having a bottom and a top;

a pair of pins extending through said pair of opposing side walls;

a pair of locking assemblies positioned on opposing sides of said partition, each locking assembly of said pair of locking assemblies having a back surface, said back surface of said each locking assembly frictionally engaging the interior surfaces of said opposing side walls, said pair of locking assemblies slidingly engaging said pair of pins to removably lock said partition within said interior of said box; and at least one spike depending from said bottom of said partition.

14. A box divider for use with a box, wherein the box has a pair of ends, a bottom and a pair of opposing side walls defining an interior, said box divider comprising:

a partition having a bottom and a top;

a pair of pins for extending through the pair of opposing side walls;

at least one spike depending from said bottom of said partition; and a pair of locking assemblies positioned on opposing sides of said partition, each locking assembly of said pair of locking assemblies having a back surface, said back surface of said each locking assembly for frictionally engaging the interior surfaces of the opposing side walls, said pair of locking assemblies slidingly engaging said pair of pins for removably locking said partition within the interior of the box, wherein said each locking assembly of said pair of locidng assemblies comprises:

a guide member extending from a side of said opposing sides of said partition, said guide member having a vertical channel formed therein, and a wedge slidably mounted on said guide member, said wedge having a top and a front surface, said wedge formed wit a vertical channel in registration with said vertical channel formed in said guide member, said vertical channel formed in said wedge dimensioned to receive a pin of said pair of pins.

15. The box divider as recited in claim 14, wherein said guide member extends beyond said top of said partition.

16. The box divider as recited in claim 14, wherein said guide member further comprises:

a first vertical member attached to said partition, a second vertical member positioned in spaced relation to said first vertical member, said second vertical member having a vertical channel formed therethrough, a first side attached to said partition and a second side formed with a groove, and wherein said wedge has a vertical channel formed therethrough in registration with said channel formed in said second vertical member, said wedge having a first side and a second side, said first side positioned between said first vertical member and said second vertical member, said second side having a lip formed therein, said lip received by said groove formed in said second side of said second vertical member.

17. The box divider as recited in claim 14, wherein said front surface of said wedge is formed of a material having a low coefficient of friction.

18. The box divider as recited in claim 14, wherein said wedge further comprises a handle extending from said top.

19. The box divider as recited in claim 13, wherein each pin of said pair of pins further comprises a substantially flat head positioned flush against the exterior surface of a side wall of the pair of side walls and a body extending from said head through the side wall and into the interior of the box, said body having at least one rib formed therealong.

20. A box divider for use with a box, wherein the box has a pair of ends, a bottom and a pair of opposing side walls, defining an interior, said box divider comprising:

a partition having a bottom and a top;

a pair of pins for extending through the opposing side walls;

a pair of locking assemblies positioned on opposing sides of said partition, each locking assembly of said pair of locking assemblies having a back surface, said back surface of said each locking assembly for frictionally engaging the interior surfaces of the opposing side walls, said pair of locking assemblies slidingly engaging said pair of pins for removably locking said partition within the interior of the box;

a base extending substantially orthogonally from said bottom of said partition, said base having a bottom surface; and at least one spike depending from said bottom surface of said base.

21. A box divider for use with a box, wherein the box has a pair of ends, a bottom and a pair of opposing side walls, defining an interior, said box divider comprising:

a partition having a bottom and a top;

a pair of pins for extending through the opposing side walls;

a pair of locking assemblies positioned on opposing sides of said partition, each locking assembly of said pair of locking assemblies having a back surface, said back surface of said each locking assembly for frictionally engaging the interior surfaces of the opposing side walls, said pair of long assemblies slidingly engaging said pair of pins for removably locking said partition within the interior of the box;

at least one spike depending from said bottom of said partition; and a top member extending from said top of said partition, said top member having tapered ends.

22. The box divider as recited in claim 14, wherein said partition and said guide member are integrally formed.

* * * * *